US007559331B2

(12) United States Patent
Ward

(10) Patent No.: US 7,559,331 B2
(45) Date of Patent: Jul. 14, 2009

(54) LINER TOOLS AND KIT FOR CUTTING HAIR

(76) Inventor: Ashley Ward, 4150 E. Main St., #1068, Mesa, AZ (US) 85205

( * ) Notice: Subject to any disclaimer, the term of this patent is extended or adjusted under 35 U.S.C. 154(b) by 462 days.

(21) Appl. No.: 11/278,661

(22) Filed: Apr. 4, 2006

(65) Prior Publication Data

US 2007/0235054 A1 Oct. 11, 2007

(51) Int. Cl.
*A45D 24/36* (2006.01)

(52) U.S. Cl. ..... 132/214

(58) Field of Classification Search ..... 132/214, 132/200, 213, 213.1; 33/511, 512; D28/10, D28/44

See application file for complete search history.

(56) References Cited

U.S. PATENT DOCUMENTS 1,385,722 A 7/1921 Sessoms
2,786,477 A * 3/1957 Cohen ..... 132/214
3,935,870 A 2/1976 Wall
4,977,672 A 12/1990 Hamilton
5,329,946 A * 7/1994 Guma ..... 132/213.1
5,427,122 A * 6/1995 Hamilton ..... 132/214
5,494,057 A * 2/1996 Gianfrancesco ..... 132/214
2004/0074511 A1 4/2004 Sussan
2008/0060667 A1 * 3/2008 Bandonis ..... 132/214

* cited by examiner

*Primary Examiner*—Robyn Doan
(74) *Attorney, Agent, or Firm*—Schmeiser, Olsen & Watts LLP

(57) ABSTRACT

Liner tools and kit for aiding in cutting hair. A liner tool comprising a handle portion coupled to at least one guide portion, a level connected to said liner tool, and a constricting mechanism coupled to said handle portion, comprising, a link connected to the guide portion, a first gear connected to said link, an engaging member configured to engage said first gear, a shaft connected to said engaging member, a first biasing member workably coupled to said shaft, a cam workably coupled to said shaft, a lock workably coupled to said cam, rotating said handle portion after activating the lock tightens the curve of the at least one guide portion. A second liner tool comprising a grip coupled to a guide portion, and a level coupled to said liner tool. A tool kit for aid in cutting hair comprising embodiments of the liner tool and second liner tool.

16 Claims, 12 Drawing Sheets

LINER TOOLS AND KIT FOR CUTTING HAIR

BACKGROUND OF THE INVENTION

1. Technical Field

This invention relates to tools and a kit for aiding in cutting hair lines when trimming hair, beards, mustaches and the like.

2. Background Art

One of the main challenges when cutting hair, particularly when cutting men's hair, is to cut an appropriately shaped, smooth hair line in the front, back and sides or even on a beard or mustache.

Over the years many inventors have attempted to solve this problem. U.S. Pat. No. 1,385,722 issued to W. T. Sessoms in 1921 illustrates a neck shaving pattern or guide which is a band or strip that hooks on the ears of the person getting their hair cut and provides a line below which the neck is shaved. This invention does not, however, allow for different shapes of necklines and does not aid the barber in cutting the front of the person's hair or their sideburns. This invention also does not guarantee a level hair line as people's ears are often lopsided.

U.S. Pat. No. 3,935,870 issued to Wall illustrates a guide means for cutting long hair. This patent illustrates a template device that fits over the shoulders of the person having their hair cut. Guides are formed on the template device showing the barber where to cut the hair. This invention, however, is not applicable to short hair.

U.S. Pat. No. 4,977,672 issued to Hamilton illustrates a hair-sculpturing structure and method. This invention is a template or stencil with a shape such as a heart opening in the center. The barber trims the hair within the opening in the template. This invention does not aid in trimming the neckline, however and is in fact primarily for novelty cuts that contain shapes.

U.S. Patent Application No. 2004/0074511 illustrates a guide for trimming facial hair. The guide is held in place by a chin plate and a neck strap. The guide allows users to trim hair along certain predetermine angles in order to get a straight and symmetrical facial hair cut. The invention cannot be used in trimming anything but facial hair.

Accordingly, what is needed is a liner tool and tool kit for aiding in cutting hair including short hair, which allows the barber to cut a smooth, level line in the desired shape on a neckline, sideburns, facial hair and the like.

DISCLOSURE OF THE INVENTION

The present invention may be readily adapted to a variety of hair cutting styles and hair line shapes. Embodiments of the present invention may provide, among other benefits: a way to trim hair into a variety of shapes while making it easy for the barber to duplicate the shape on both sides of the head.

In particular embodiments, a liner tool for aiding in cutting hair configured according to an embodiment of the present invention comprises: a handle portion; at least one guide portion workably coupled to said handle portion, wherein said at least one guide portion is curved in order to circumscribe a section of a head, a level connected to said liner tool, wherein said level describes the angle of the at least one guide portion; and a constricting mechanism coupled to said handle portion, said constricting mechanism comprising, a link connected to said at least one guide portion, a first gear connected to said link, an engaging member configured to engage said first gear, a shaft connected to said engaging member, a first biasing member workably coupled to said shaft, a cam workably coupled to said shaft, a lock workably coupled to said cam, wherein activating said lock fixedly couples said engaging member to said first gear and thereafter rotating said handle portion tightens the curve of the at least one guide portion.

A second liner tool configured according to embodiments of the present invention comprise: a grip, a guide portion coupled to said grip wherein said guide portion comprises an edge along which a user trims hair, and a level coupled to said second liner tool wherein said level describes the angle of the guide portion.

A tool kit for aid in cutting hair configured according to the present invention comprising: a liner tool for aiding in cutting hair comprising, a handle portion, at least one guide portion workably coupled to said handle portion, wherein said at least one guide portion is curved in order to circumscribe a section of a head, a level connected to said liner tool, wherein said level describes the angle of the at least one guide portion, a constricting mechanism coupled to said handle portion, said constricting mechanism comprising, a link connected to said at least one guide portion, a first gear connected to said link, a second gear workably coupled to said first gear, a second biasing member coupled to said second gear, an engaging member configured to engage said first gear, a shaft connected to said engaging member, a first biasing member workably coupled to said shaft, a cam workably coupled to said shaft, a lock workably coupled to said cam, wherein activating said lock fixedly couples said engaging member to said first gear and thereafter rotating said handle portion tightens the curve of the at least one guide portion, wherein a second activation of said lock releases said engaging member from said first gear and allows that at least one guide portion to return to its original shape, and at least one second liner tool for aiding in cutting hair comprising, a grip, a second liner tool guide portion coupled to said grip wherein said second liner tool guide portion comprises an edge along which a user trims hair, a second liner tool level coupled to said second liner tool wherein said second liner tool level describes the angle of the second liner tool guide portion The foregoing and other features and advantages of the invention will be apparent to those of ordinary skill in the art from the following more particular description of the invention and the accompanying drawings.

BRIEF DESCRIPTION OF THE DRAWINGS

The invention will hereinafter be described in conjunction with the appended drawings where like designations denote like elements, and.

DESCRIPTION OF THE INVENTION

As discussed above, embodiments of the present invention relate to liner tools and a kit thereof for aid in cutting hair. A liner tool allows a user to cut a line in a person's hair in order to edge the sideburns, front of the head, back of the head or even to trim facial hair. The liner tool also allows a user to repeat the same line on the other sideburn or other side of the head. Generally, a liner tool configured according to embodiments of the present invention comprise a grip or handle, a guide and a level.

FIGS. 1, 2, 5 and 6 illustrate a liner tool 20 configured according to an embodiment of the present invention. The liner tool 20 comprises a handle portion 28. The handle portion 28 allows the user to hold the liner tool 20 in position in order to cut hair. The handle portion 28 may be formed from any material that is strong enough to support the rest of the liner tool 20. The handle portion 28 may also have a hand grip 24 formed in it. The handle portion 28, however, may be configured in order to allow the liner tool 20 to be gripped by hand, held between the user's knees, held in a stand or the like and the grip 24 may be configured for any one of these methods of holding. The handle portion 28 should be a size that is easy for a user to hold and manipulate and should be formed from a light weight material so that the user can easily support the liner tool 20.

Figure 1:
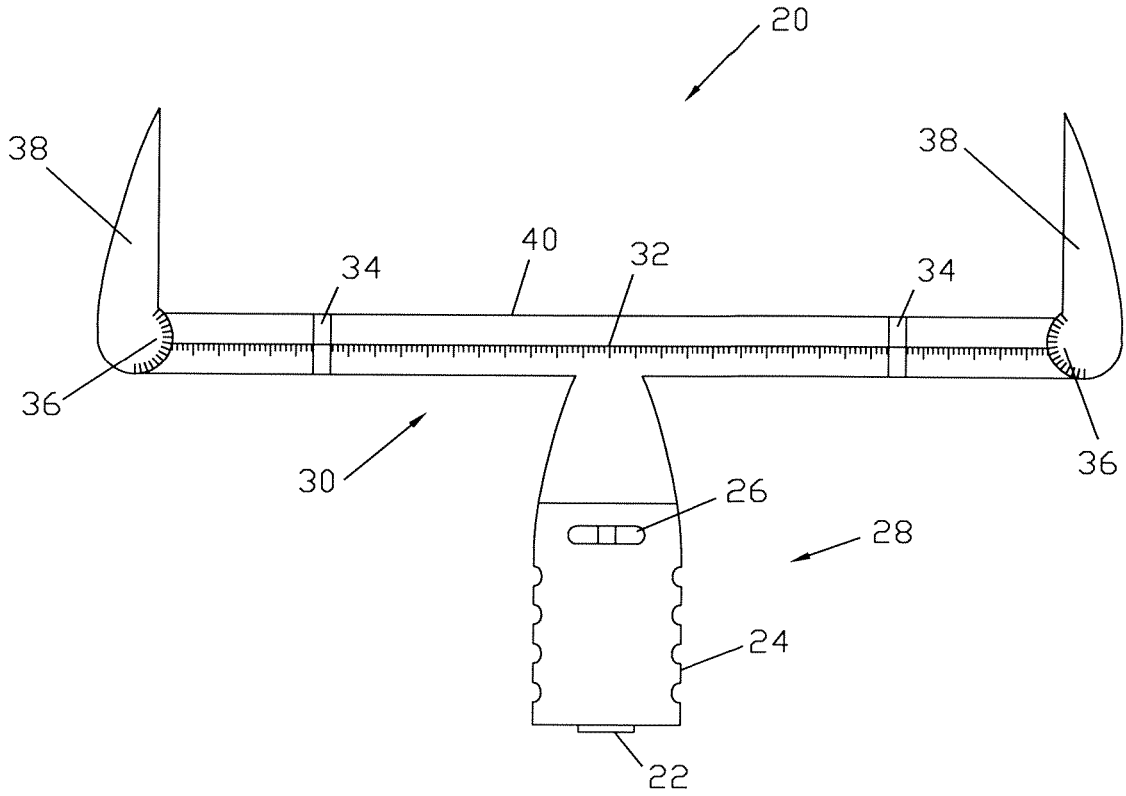
FIG. 1 is a front view of a liner tool for aid in cutting hair configured according to an embodiment of the present invention.
Figure 2:
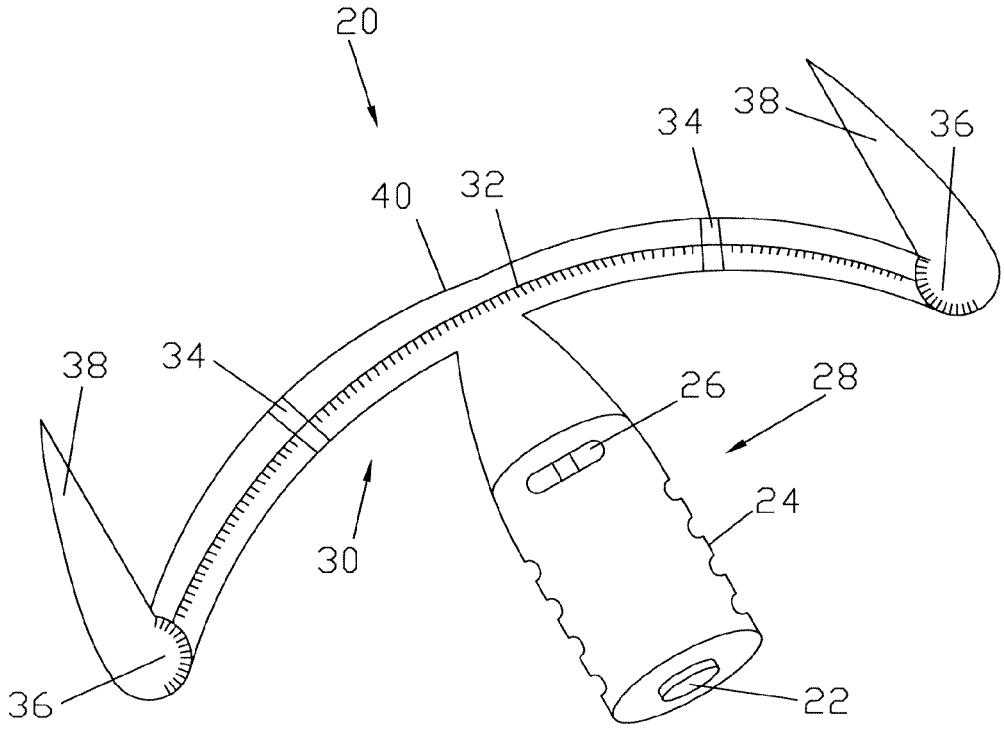
FIG. 2 is an isometric view of a liner tool for aid in cutting hair configured according to an embodiment of the present invention.

The liner tool 20 also comprises at least one guide portion 30. The guide portion 30 is connected to the handle portion 28. When the liner tool 20 is in use, the handle portion 28 is held by the user and the guide portion 30 is supported against the head of the person whose hair is being cut. The guide portion 30 may be formed in any shape desirable. FIGS. 1 and 2 illustrate a guide portion 30 that allow the user to cut a straight line or rectangular shape in a person's hair. Typically this type of guide portion 30 would be used to cut the back or neckline of a person's hair.

Figure 5:
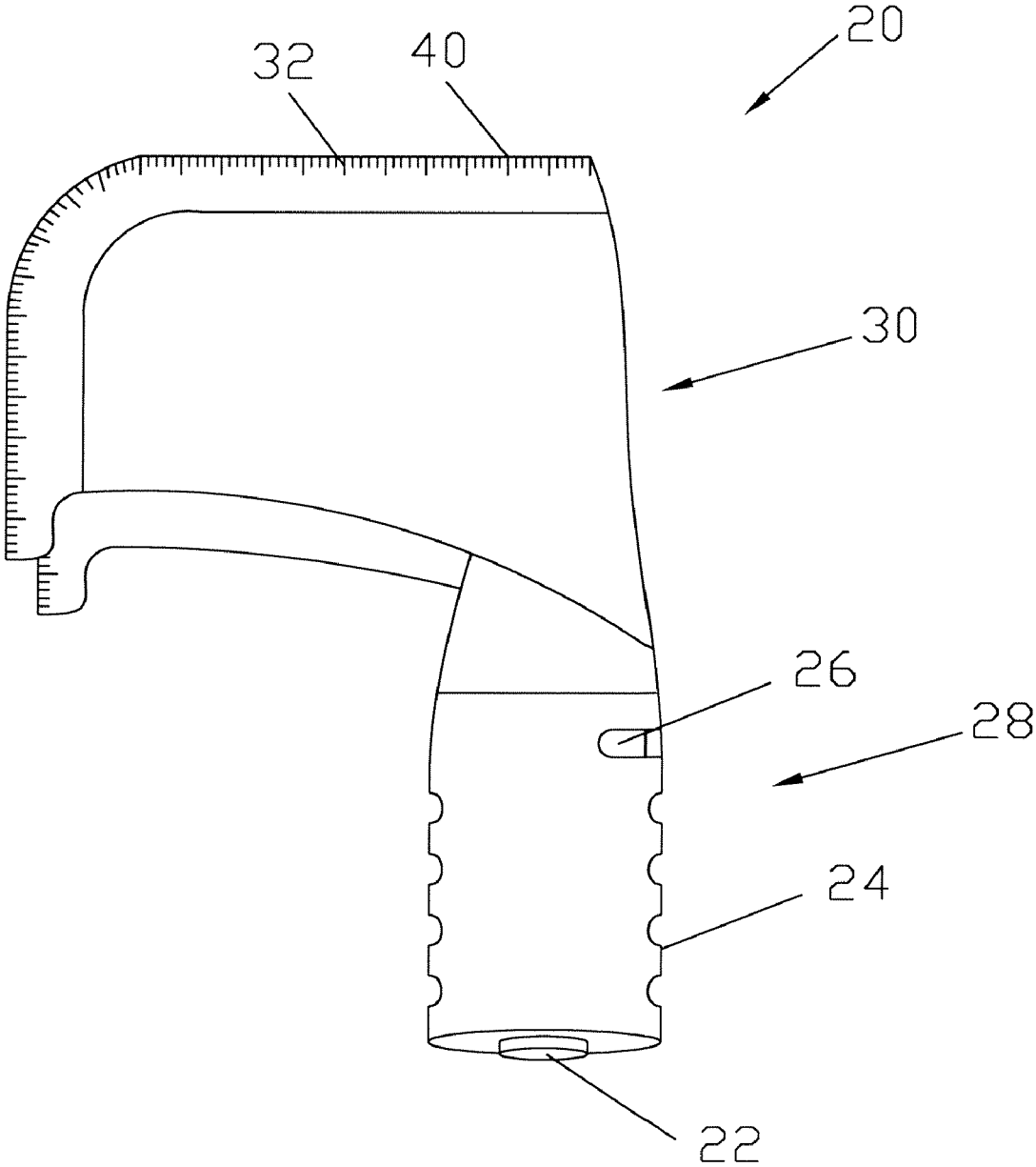
FIG. 5 is a side view of a liner tool for aid in cutting hair configured according to a second embodiment of the present invention.
Figure 6:
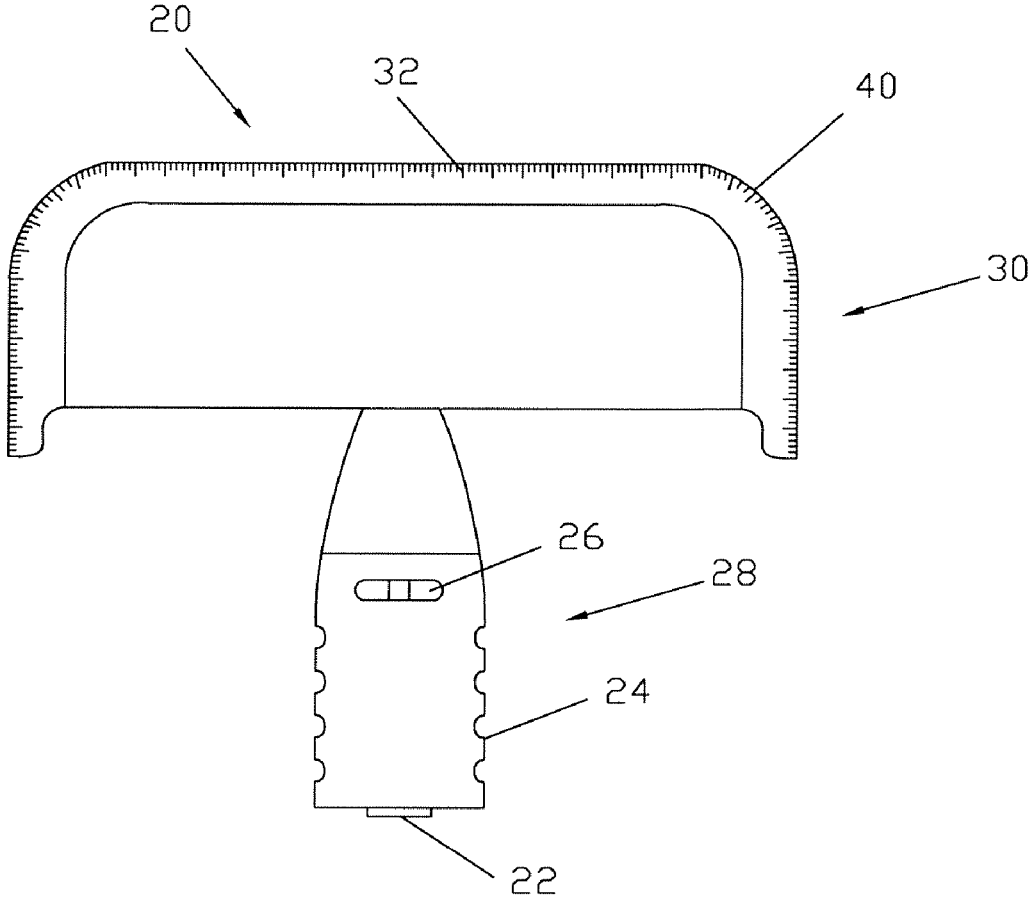
FIG. 6 is a front view of a liner tool for aid in cutting hair configured according to a second embodiment of the present invention.
Figure 7:
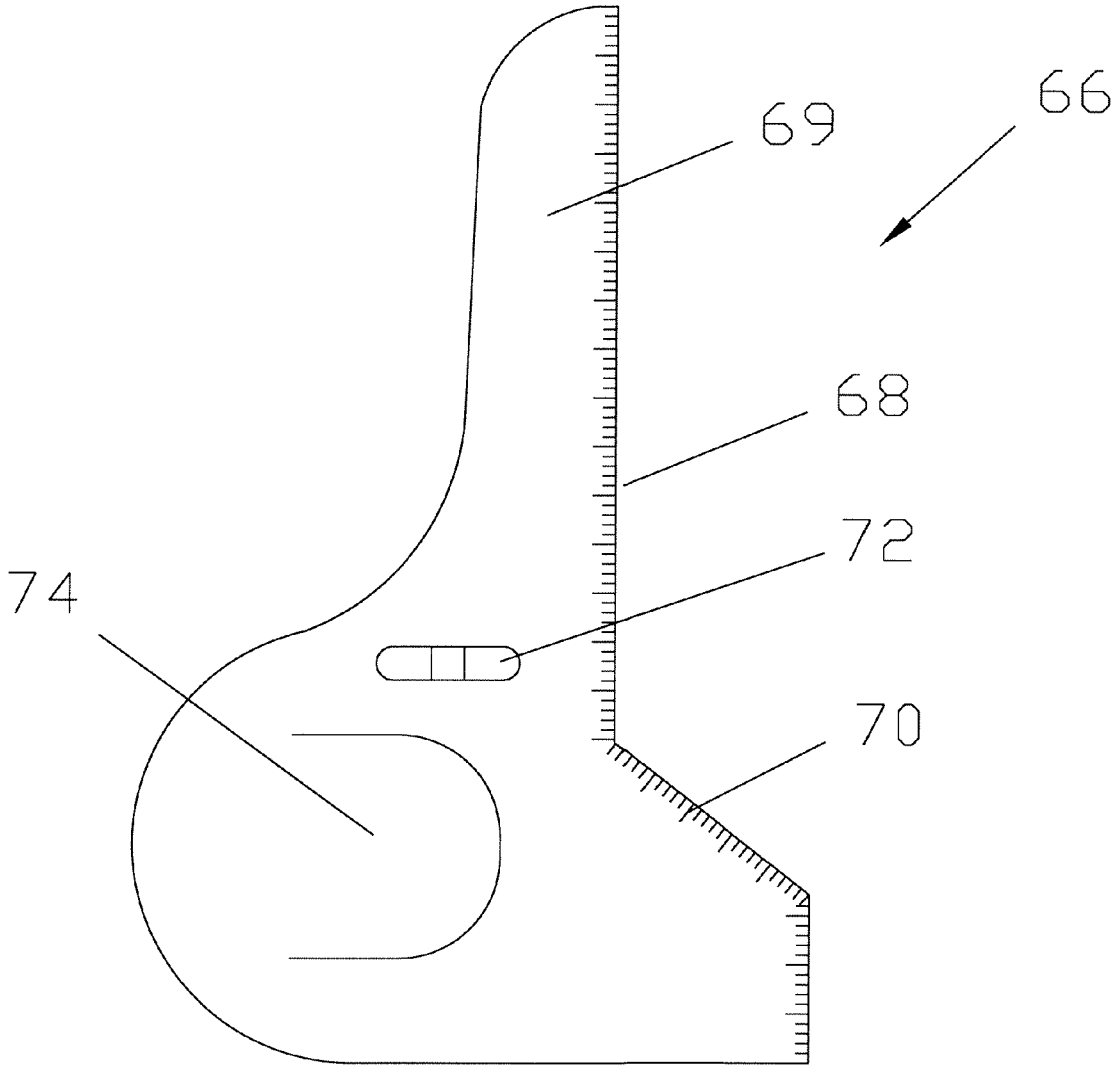
FIG. 7 is a front view of a second liner tool for aid in cutting hair configured according to an embodiment of the present invention.
Figure 8:
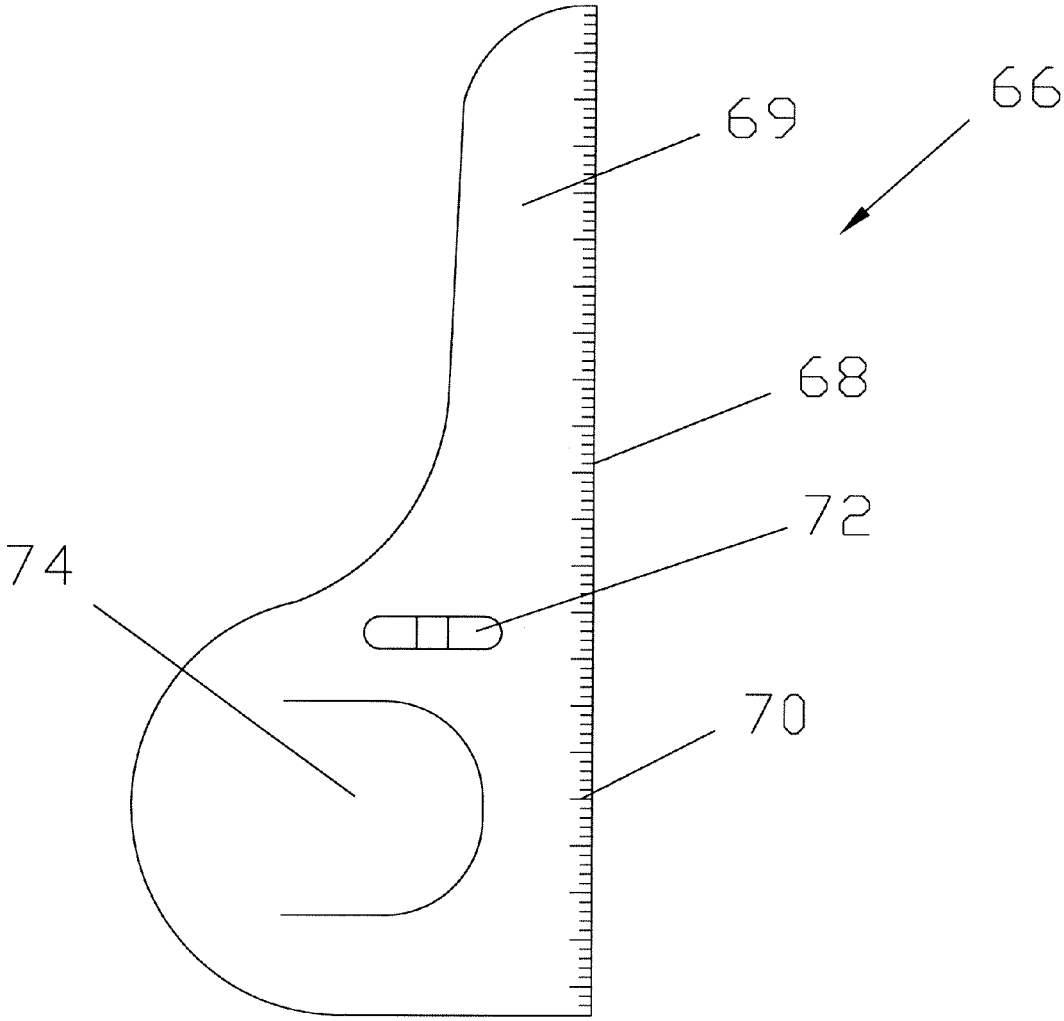
FIG. 8 is a front view of a second liner tool for aid in cutting hair configured according to a second embodiment of the present invention.
Figure 9:
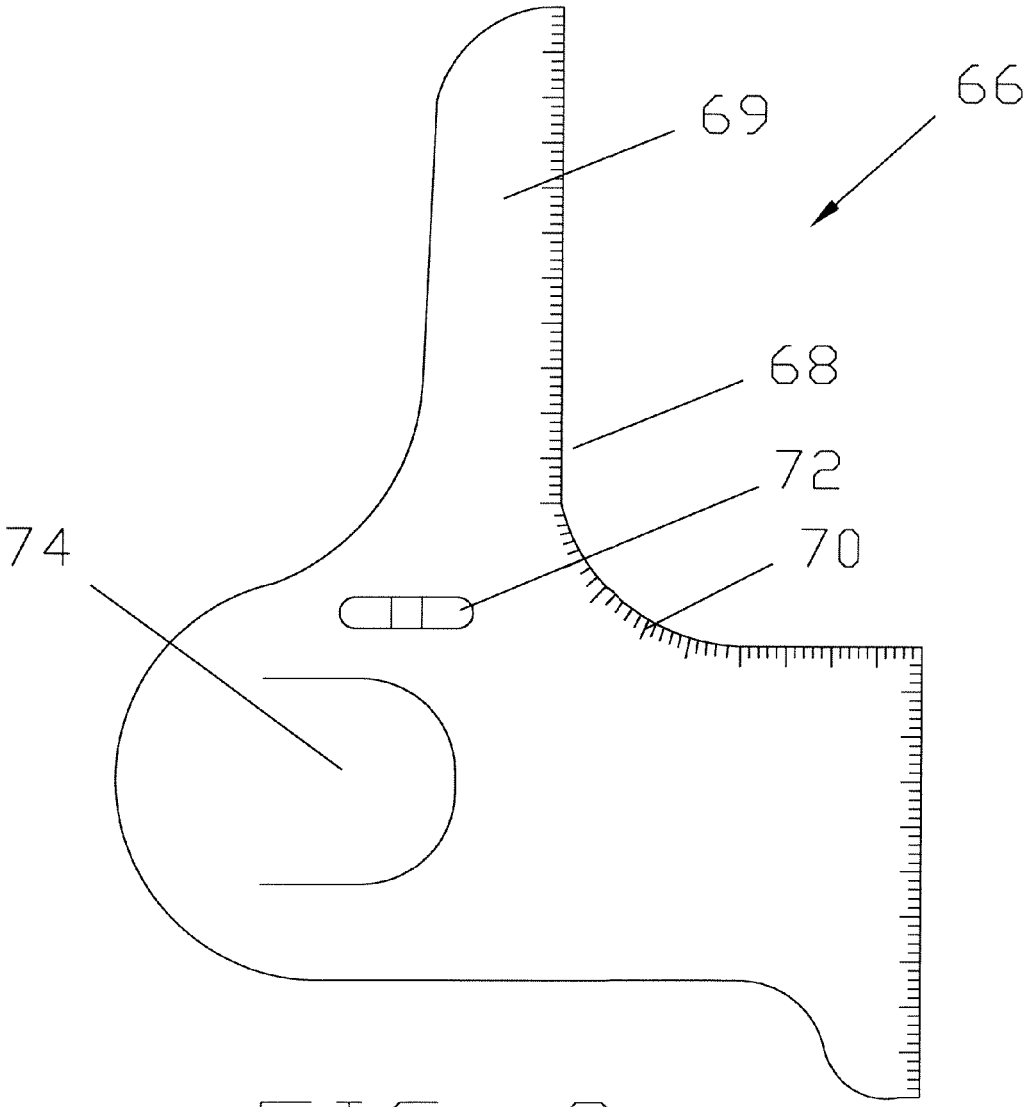
FIG. 9 is a front view of a second liner tool for aid in cutting hair configured according to a third embodiment of the present invention.
Figure 10:
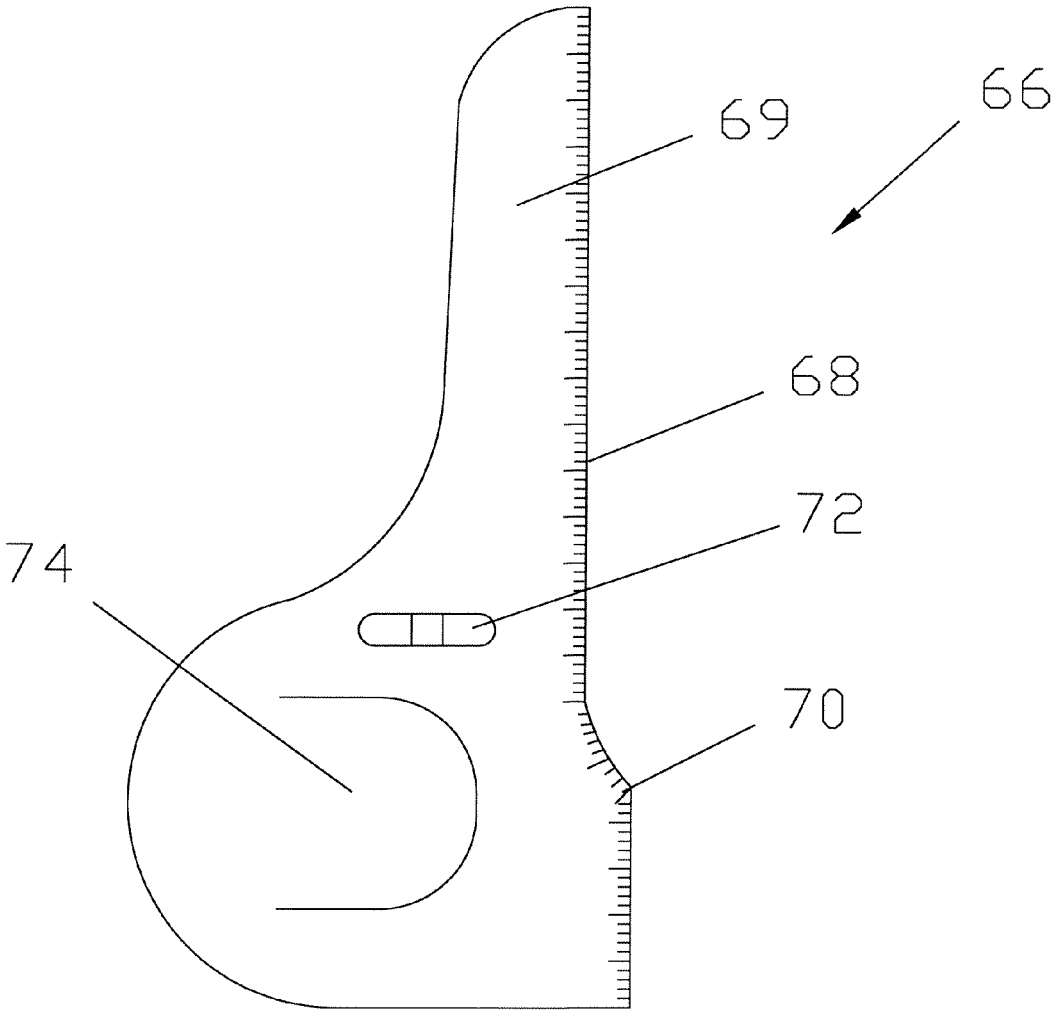
FIG. 10 is a front view of a second liner tool for aid in cutting hair configured according to a fourth embodiment of the present invention.
Figure 11:
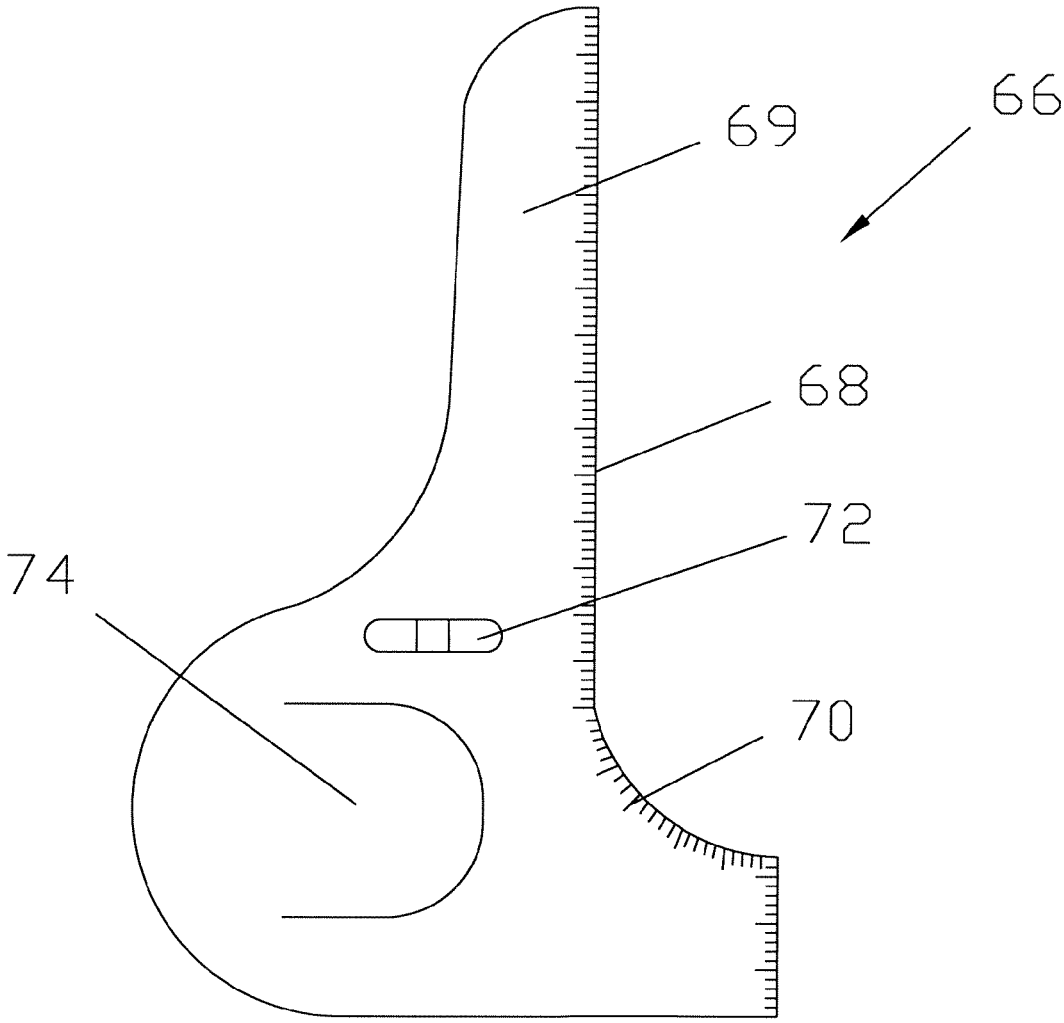
FIG. 11 is a front view of a second liner tool for aid in cutting hair configured according to a fifth embodiment of the present invention.
Figure 12:
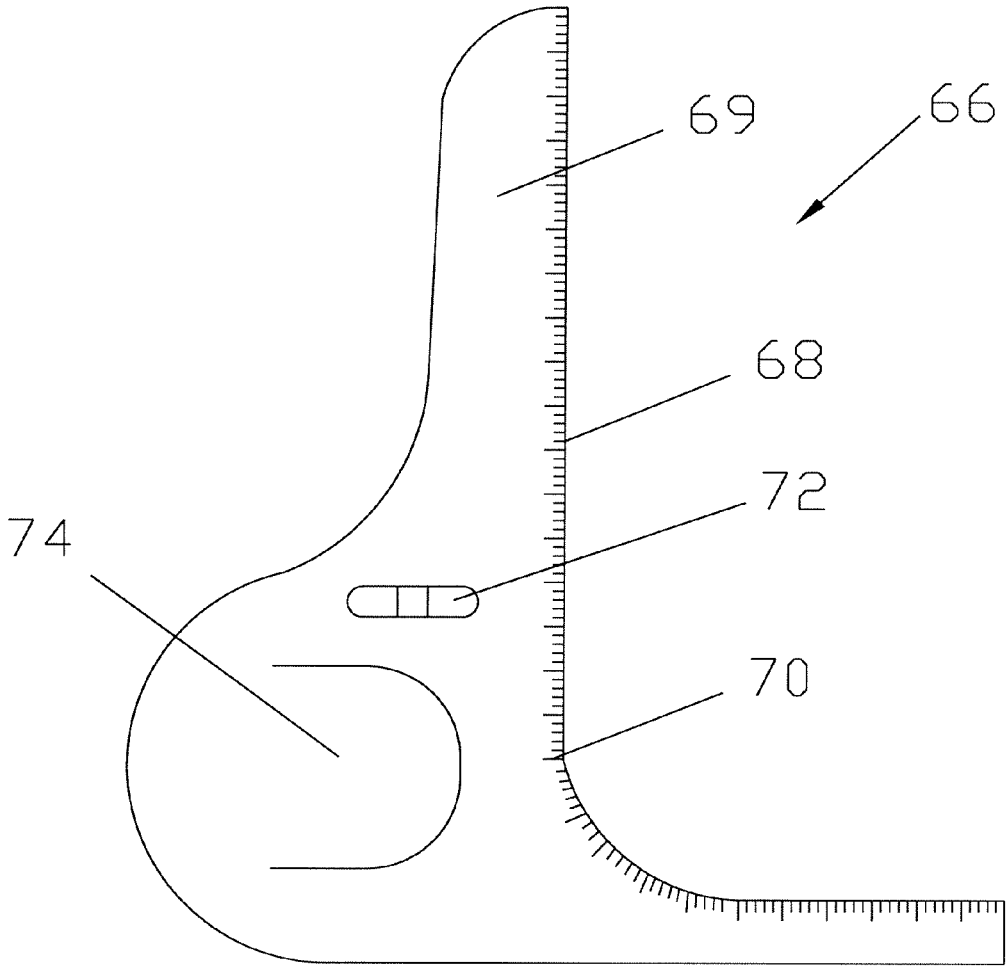
FIG. 12 is a front view of a second liner tool for aid in cutting hair configured according to a sixth embodiment of the present invention.

FIGS. 5 and 6 illustrate a guide portion 30 in an inverted arc. This type of guide portion 30 typically would be used to cut the front of a person's hair. This type of guide portion 30 allows the user to cut the person's sideburns at the same time that the user cuts the front of their hair.

The guide portion 30 may be removable from the handle portion 28. This allows the user to remove one guide portion 30 and replace it with a second guide portion 30.

The guide portions 30 illustrated in FIGS. 1, 2, 5 and 6 are curved or arched away from the handle portion 28, with the handle portion 28 being located at the top of the arch and the ends of the guide portions 30 being the ends of the arch. The arched shape of the guide portions 30 allow the guide portions 30 to fit against the contours of a head and make cutting a line in a person's hair easier.

The guide portions 30 may also be formed from resilient material in order to more easily fit around the head of a user. The guide portions 30 in embodiments of the present invention may also contain transparent portions which allow the user to see through the guide portions 30 and determine the position of the guide portions 30 with respect to the hair they are cutting. This prevents the user from cutting a neckline that is too low or too high up the neck.

The guide portion 30 comprises a cutting edge 40 which is the edge along which the user runs their razor or scissors in order to cut hair. The cutting edge 40 also has measurement markings 32 which allow the user to cut a line of predetermined length in a person's hair. The measurement markings 32 also allow the user to start and stop the line at a predetermined location in order to make a person's hair symmetrical.

The guide portion 30 may further comprise at least one expander 34. In the embodiments illustrated in FIGS. 1 and 2, two expanders 34 are shown. The expanders 34 allow the user to shorten or lengthen the guide portion 30. In order to shorten or lengthen the guide portion 30 by using the expanders 34. The user simply holds the handle portion 28 firmly and then pulls the end of the guide portion 30 away from the handle portion 28 sliding the expander 34 open. The liner tool 20 therefore has the ability to be used on any size head from a child's to an adult's. The expander 34 may also be formed from resilient and/or transparent material like the guide portion 30.

The guide portion 30 illustrated in FIGS. 1 and 2 further comprise at least one extender 38. The guide portion 30 illustrated in these figures comprise two extenders 38. The extenders 38 are rotatably connected to the guide portion 30 allowing the user to determine the angles between the guide portion 30 and the extenders 38. The extenders 38 allow the user to cut angles or vertical edges at the end of the neckline. This allows the user to create square or rectangular necklines and to cut up to and maybe even behind a person's ears. It may be desirable to form the extenders 38 from resilient and/or transparent material. Transparent extenders 38 may allow the user to determine the appropriate location for the edges of the neckline that fall behind the person's ears.

The extenders 38 are marked with angle markings 36 which allow the user to angle both extenders 38 at the same angle and therefore allow the user to cut a symmetrical neckline.

As illustrated in FIGS. 1, 2, 5 and 6, the liner tool 20 also comprises a level 26 which describes the angle of the at least one guide portion 30. The level 26 may be located anywhere on the liner tool 20 that allows the level 26 to be viewed easily by the user and which allows the level 26 to define the angle at which the guide portion 30 and in particular the cutting edge 40 of the guide portion 30 is being held. This allows the user to easily cut a level line in the hair of a person's head.

Figure 3:
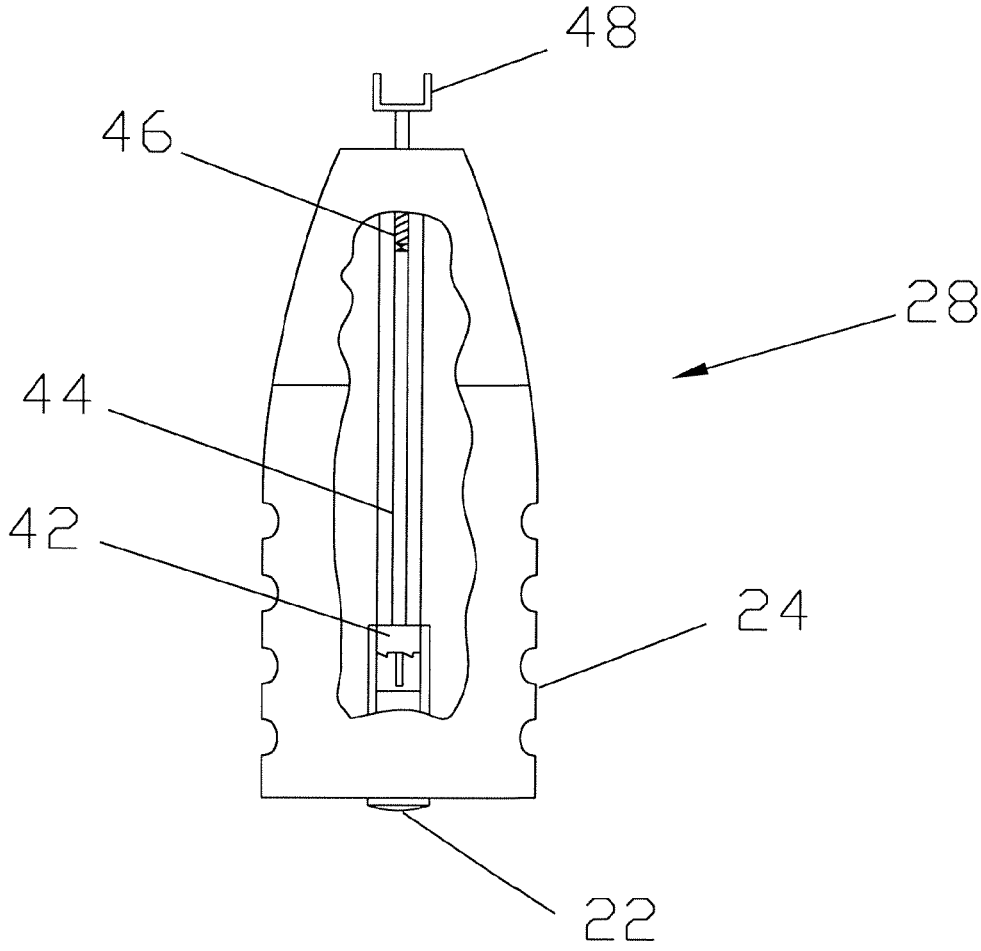
FIG. 3 is a cut away of a side view of a handle of a liner tool for aid in cutting hair configured according to an embodiment of the present invention.
Figure 4:
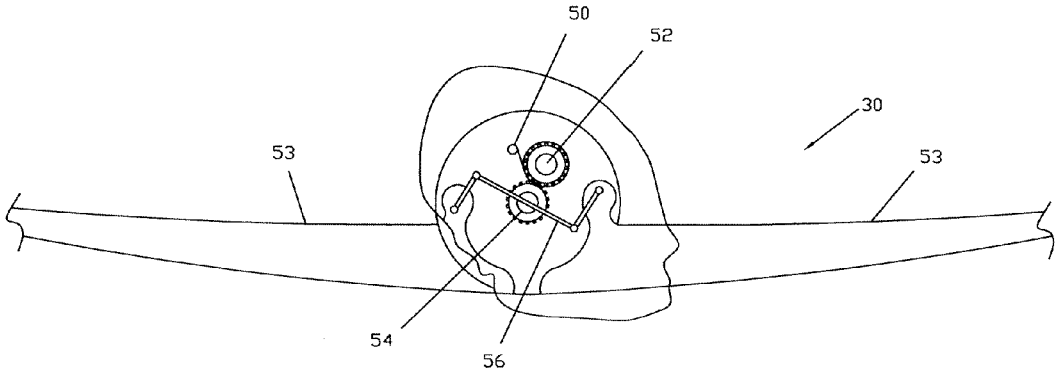
FIG. 4 is a cut away of a top view of a liner tool for aid in cutting hair configured according to an embodiment of the present invention.

The liner tool 20 further comprises a constricting mechanism as illustrated in FIGS. 3 and 4. The constricting mechanism comprises a link 56 which is coupled to the at least one guide portion 30. The link 56 as illustrated in these figures may be a multipart hinged link which connects to at least two points on the at least one guide portion 30. The link 56 acts to pull the sides 53 of the guide portion 30 towards each other and by doing such constricting the arch in the guide portion 30. This allows the user to constrict the arch in the guide portion 30 to better fit the head of the person whose hair is being cut. In order for the link 56 to constrict the guide portion 30, the guide portion 30 must be able to bend at a location between the points to which the link 56 is attached. This may require that the guide portion 30 be formed from resilient material or that a hinge or other bendable device be located between the points.

The link 56 may be formed in any shape or number of pieces that allow it to, when rotated, pull the points to which it is attached to the guide portion 30 into a position which constricts the curve or arch of the guide portion 30. As illustrated in these figures, the link 56 may be formed from three separate rod-like members. These members are hingedly connected to each other. Therefore, when rotation is applied to the center member, the other two members change the angle of their orientation with respect to the center member. For example, as the center member is rotated into a position that is perpendicular to the guide portion 30, the other members are placed into a position parallel to the guide portion 30 which pulls the points on the guide portion 30 closer to each other and tighten the curve of the guide portion 30.

The link 56 is rotated by a first gear 54. By rotating the link 56, the ends of the link 56 pull the guide portion 30 into a more constricted arch.

The first gear 54 may mesh with a second gear 52 in embodiments of the present invention. The second gear 52 is biased by a second biasing member 50 which applies pressure on the second gear 52 to rotate in the direction opposite to that which the first gear 54 would cause it to rotate. Therefore, once the rotation force is removed from the first gear 54, the biasing member 50 causes the second gear 52 to force the first gear 54 to its original position and to return the guide portion 30 to its unconstricted position.

The first and second gears 52 and 54 as utilized in embodiments of the present invention may be gears with meshing teeth or may be any other type of mechanisms that transfer rotation or that perform the desired transfer of motion.

The second biasing member 50 may be any device that holds kinetic energy in order to force the guide portion 30 to its original position. The second biasing member 50 may be a spring or the like.

If the guide portion 30 is formed from resilient material that tends to return to its previous shape once force has been removed from it, then the second gear 52 and the second biasing member 50 may not be required. Instead, when the force is removed from the first gear 54, the guide portion 30 would return to its original position without an applied force.

In order to constrict the guide portion 30, the user engages the lock 22. In the embodiment illustrated in FIGS. 3 and 4, the lock 22 is a button that engages a cam 42 and pushes a shaft 44 upward. The end of the shaft 44 which is opposite the lock 22 is connected to an engaging member 48. The engaging member 48 is pushed upward engaging the first gear 54. The shaft 44 may be formed in any shape desirable. As shown, the shaft 44 is long enough to connect the lock 22 and the engaging member 48. The shaft 44 may be formed from a variety of materials so long as they are strong enough to perform the desired function.

The lock 22 may be any device which forces the shaft upward. This can be done with a button such as that illustrated in the figures or it can be done by a rotating member or any other element that forces the shaft 44 upward.

The cam 42 simply allows the lock to operate as a toggle. The cam may not be necessary if it is prefired that the lock not operate as a toggle. The cam 42 holds the shaft 44 in its upward position until the lock 22 is activated a second time.

Once the engaging member 48 is engaged with the first gear 54, the handle portion 28, which is coupled to the shaft 44, cam 42, engaging member 48 or any other element which is connected to the engaging member 48 in a way that it would transfer rotation, is rotated. The rotation of the handle portion 28 is transferred to the first gear 54 which constricts the guide portion 30.

When the lock 22 is activated a second time, a first biasing member 46 forces the shaft 44 back into its original position. The first biasing member 46 may be any device that applies force to the shaft 44, such as a spring or the like.

An embodiment of a second liner tool for aiding in cutting hair is illustrated in FIGS. 7-12. The second liner tool 66 is configured primarily for use on sideburns, facial hair and the like. The second liner tool 66 comprising a grip 74. The grip 74 being configured to receive a thumb on the front and the remaining fingers which the user desires to use on the back of the grip 74. Though, the grip 74 may be configured in order to receive any hold desired or could even be configured to be held in a stand or the like.

The grip 74 is connected to a guide portion 69. The guide portion 69 comprises a cutting edge 68 along which the user runs their scissors or razor in order to cut a person's hair. The cutting edge 68 configured to run almost perpendicular to the head of hair being cut. The guide portion 69 may be formed from any material which holds its shape in order to provide an edge along which the user can cut. It may be desirable, however, for the guide portion 69 and even the grip 74 to be formed from a resilient material. It may also be desirable for the guide portion 69 and the grip 74 to be formed from a transparent material which would allow the user to properly position the second liner tool 66 with respect to the hair which is being cut.

The guide portion 69 may also comprise measurement markings 70 which allow the user to determine the desired length of the cut and to repeat the length on the opposite side of the person's head.

The guide portion 69 may be formed in any shape desired or in other words may have a cutting edge that allows the user to cut any line type desired. It is possible that the guide portion 69 may be removable from the grip 74, thereby allowing the user to purchase multiple guide portions 69 in different shapes.

The second liner tool 66 also may comprise a cross-section that tapers towards the cutting edge 68. The tapered cross section may allow the user to cut along the cutting edge 68 without the edge interfering with the razor or scissors. The tapered cross-section also provides a thicker grip 74 which may make holding the second liner tool 66 easier for the user.

The second liner tool 66 further comprises a level which defines the position or angle of the guide portion 69 or more particularly the cutting edge 68 of the guide portion 69. This allows the user to cut lines that are perfectly perpendicular or horizontal and therefore the user would not be required to attempt to create level lines by utilizing landmarks such as the person's ears or the like which tend not be level.

In order to allow the user to use the second liner tool 66 on either side of a person's head, it is anticipated that the second liner tool 66 could be identical on its front and back and could therefore be used with the cutting edge facing either direction.

In order to provide a user with a complete hair cutting liner kit, a liner tool as described in FIGS. 1-6 may be provided with multiple guide portions 30 which may be interchanged. The hair cutting liner kit as configured according to embodiments of the present invention would also contain multiple second liner tools 66 with various cutting edge 68 shapes. Therefore, the user would have the ability to cut any type or shape of hair or facial hair desired.

Accordingly, for the exemplary purposes of this disclosure, the components defining any embodiment of the invention may be formed as one piece if it is possible for the components to still serve their function. The components may also be composed of any of many different types of materials or combinations thereof that can readily be formed into shaped objects provided that the components selected are consistent with the intended mechanical operation of the invention. For example, the components may be formed of rubbers (synthetic and/or natural), glasses, composites such as fiberglass, carbon-fiber and/or other like materials, polymers such as plastic, polycarbonate, PVC plastic, ABS plastic, polystyrene, polypropylene, acrylic, nylon, phenolic, any combination thereof, and/or other like materials, metals, such as zinc, magnesium, titanium, copper, iron, steel, stainless steel, any combination thereof, and/or other like materials, alloys, such as aluminum, and/or other like materials, any other suitable material, and/or any combination thereof.

The embodiments and examples set forth herein were presented in order to best explain the present invention and its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the drawings or herein are given as an example of possible components and not as a limitation.

The invention claimed is:

1. A liner tool for aiding in cutting hair, said liner tool comprising:

a handle portion;

at least one guide portion workably coupled to said handle portion, wherein said at least one guide portion is curved in order to circumscribe a section of a head;

a level connected to said liner tool, wherein said level describes the angle of the at least one guide portion; and a constricting mechanism coupled to said handle portion, said constricting mechanism comprising, a link connected to said at least one guide portion, a first gear connected to said link, an engaging member configured to engage said first gear, a shaft connected to said engaging member, a first biasing member workably coupled to said shaft, a cam workably coupled to said shaft, a lock workably coupled to said cam;

wherein activating said lock fixedly couples said engaging member to said first gear and thereafter rotating said handle portion tightens the curve of the at least one guide portion.

2. The liner tool of claim 1, further comprising a second gear workably coupled to said first gear, and a second biasing member coupled to said second gear wherein said second biasing member biases said at least one guide portion towards its widest curved shape.

3. The liner tool of claim 1, wherein said at least one guide portion further comprises at least one expander.

4. The liner tool of claim 1, further comprising at least one extender rotatably coupled to said at least one guide portion.

5. The liner tool of claim 4, wherein the at least one guide portion allows a user to cut a horizontal line across hair and wherein the at least one extender rotates from a position parallel to the at least one guide portion and perpendicular to the at least one guide portion.

6. The liner tool of claim 4, wherein the at least one extender further comprises marks for determining the degree of rotation of the at least one extender.

7. The liner tool of claim 1, wherein the at least one guide portion further comprises transparent portions.

8. The liner tool of claim 1, wherein a second activation of said lock releases said engaging member from said first gear and allows that at least one guide portion to return to its original shape.

9. The liner tool of claim 1, wherein the at least one guide portion comprises a resilient material.

10. The liner tool of claim 1, wherein the at least one guide portion is interchangeable with various shaped at least one guide portions.

11. The liner tool of claim 1, wherein the at least one guide portion further comprises measurement markings.

12. The liner tool of claim 1, wherein the at least one guide portion further comprises an arc-like shape in the direction perpendicular to the curve circumscribing a head.

13. A tool kit for aid in cutting hair, said kit comprising:

a liner tool for aiding in cutting hair comprising, a handle portion, at least one guide portion workably coupled to said handle portion, wherein said at least one guide portion is curved in order to circumscribe a section of a head, a level connected to said liner tool, wherein said level describes the angle of the at least one guide portion, a constricting mechanism coupled to said handle portion, said constricting mechanism comprising, a link connected to said at least one guide portion, a first gear connected to said link, a second gear workably coupled to said first gear, a second biasing member coupled to said second gear, an engaging member configured to engage said first gear, a shaft connected to said engaging member, a first biasing member workably coupled to said shaft, a cam workably coupled to said shaft, a lock workably coupled to said cam, wherein activating said lock fixedly couples said engaging member to said first gear and thereafter rotating said handle portion tightens the curve of the at least one guide portion, wherein a second activation of said lock releases said engaging member from said first gear and allows that at least one guide portion to return to its original shape; and at least one second liner tool for aiding in cutting hair comprising, a grip, a second liner tool guide portion coupled to said grip wherein said second liner tool guide portion comprises an edge along which a user trims hair, a second liner tool level coupled to said second liner tool wherein said second liner tool level describes the angle of the second liner tool guide portion.

14. The kit of claim 13, further comprising at least one alternate guide portion wherein the at least one alternate guide portion is interchangeable with the at least one guide portion.

15. The kit of claim 14, wherein the at least one guide portion, the second liner tool guide portion and the at least one alternate guide portion further comprise transparent portions.

16. The kit of claim 14, wherein at least one of the at least one alternate guide portions further comprises an arc-like shape in the direction perpendicular to the curve circumscribing a head.

* * * * *